US005823409A

United States Patent [19]

Kennedy

[11] Patent Number: 5,823,409

[45] Date of Patent: Oct. 20, 1998

[54] EXPANDABLE STRAP FOR A WRIST INSTRUMENT

[75] Inventor: Amelia Kennedy, Woodbury, Conn.

[73] Assignee: Timex Corporation, Middlebury, Conn.

[21] Appl. No.: 812,873

[22] Filed: Mar. 6, 1997

[51] Int. Cl.[6] ..... A44C 5/00; A44C 5/04

[52] U.S. Cl. ..... 224/175; 224/221; 63/5.1; 24/265 WS; 24/301

[58] Field of Search ..... 224/164, 175, 224/219, 221, 222; 63/5.1, 5.2, 6; 24/265 WS, 300, 301, 302

[56] References Cited

U.S. PATENT DOCUMENTS

| | | | |
|---|---|---|---|
| Re. 24,502 | 7/1958 | Myerson . | |
| 1,140,445 | 5/1915 | Collingwood | 63/5.1 |
| 1,526,702 | 2/1925 | Feid | 63/5.1 |
| 2,558,007 | 6/1951 | Smith . | |
| 2,695,740 | 11/1954 | Kolbe . | |
| 2,788,163 | 4/1957 | Butts . | |
| 4,757,926 | 7/1988 | Leo | 224/219 |
| 5,448,805 | 9/1995 | Allen et al. | 24/300 |

FOREIGN PATENT DOCUMENTS

| | | | |
|---|---|---|---|
| 487153 | 6/1918 | France | 63/5.2 |
| 1017304 | 12/1952 | France | 63/5.1 |
| 515716 | 2/1955 | Italy | 224/175 |
| 969174 | 9/1964 | United Kingdom | 63/5.1 |

*Primary Examiner*—Allan N. Shoap
*Assistant Examiner*—Gregory M. Vidowich
*Attorney, Agent, or Firm*—Arthur G. Schaier

[57] ABSTRACT

A wrist instrument has an expandable strap for use in securing the instrument about a wearer's wrist. The expandable strap has a strap casing or a sheath on each end and an interconnecting member attached to the strap casings. The interconnecting member includes a non-expandable section and at least one elastic member housed in one of the strap casings. The elastic member is attached to both the strap casing housing it and the non-expandable section of the interconnecting member such that when a pulling force is exerted on the interconnecting member, the elastic member expands within the strap casing to allow the strap to accommodate different wrist sizes without exposing the elastic member to view.

12 Claims, 2 Drawing Sheets

EXPANDABLE STRAP FOR A WRIST INSTRUMENT

This invention relates generally to a buckleless expandable strap for use in securing a wrist instrument about the wrist. More specifically, the invention relates to a buckleless expandable strap for a wrist instrument which has the overall appearance of a non-expandable strap, such as strap made of leather.

BACKGROUND OF THE INVENTION

Wrist instruments have traditionally been provided with straps made of aesthetically appealing but non-expandable materials, most notably leather, to secure the instruments about the wrist. These non-expandable straps typically comprise two sections which are detachably secured together by interlocking coupling means, such as a buckle, hook, snap, or the like. While aesthetically pleasing, the non-expandable straps present the problem of not being easily adjustable to accommodate different wrist sizes.

By contrast, straps made of expandable materials are readily adjustable to accommodate different wrist sizes. These expandable straps, which require no interlocking coupling means, are well-known in the art. For example, U.S. Pat. No. Re. 24,502 ('502), reissued Jul. 8, 1958, discloses an expansible wristwatch strap having two non-expandable sections forming sheaths which are connectable by interlocking fastening elements, and which are connected by an elastic member running through the sheaths. Another example is U.S. Pat. No. 2,558,007 ('007), issued Jun. 26, 1951, which discloses a buckleless expandable strap 12 for a wristwatch 10, as shown in FIGS. 1–3. The strap 12 comprises a non-expandable casing or sheath 14 within which is located a pair of non-expandable, opposing strap sections 18 and 20, each strap section having an outer end and an inner end. The outer ends of the strap sections 18 and 20 extend outwardly from the casing 14 and are provided with sleeves 22 and 24 for engageably receiving attaching pins of the wristwatch 10. The inner ends of the strap sections 18 and 20 are spaced from each other within the casing 14 and are joined by a resilient, expandable member 30. It is the resilient, expandable member 30 which provides the expandable qualities to the strap 12.

Although the prior art expandable bands for wrist instruments were satisfactory in accommodating the wrist instruments to fit different wrist sizes, they were unsatisfactory from the standpoint of aesthetic appeal. For example, the '502 reissue patent's elastic member is exposed to view from under the sheaths when the band is expanded, giving the band an unappealing look. Likewise, the strap sections 18 and 20 of the '007 patent are exposed to view underneath the casing 14 when the strap 12 is expanded, making the strap 12 appear unnatural and unattractive. Therefore, it is one object of the present invention to provide an expandable strap for a wrist instrument which has a natural, attractive appearance of a non-expandable strap, such as strap made of leather, even when expanded.

It is another object of the present invention to provide an expandable strap for a wrist instrument having a simple, efficient design and relatively low manufacturing cost.

SUMMARY OF THE INVENTION

Briefly stated, this invention relates to an improved wrist instrument of the type having a case, wherein the improvement comprises a strap comprising a first strap casing and a second strap casing, each strap casing being attached to the case, and an interconnecting member connected to the first strap casing and the second strap casing, the interconnecting member including a non-expandable section and at least one elastic member which is housed in one of the strap casings, the elastic member being attached to both the strap casing housing it and the non-expandable section of the interconnecting member such that when a pulling force is exerted on the interconnecting member, the elastic member expands within the strap casing to allow the strap to accommodate different wrist sizes without exposing the elastic member to view.

BRIEF DESCRIPTION OF THE DRAWINGS

The invention, both as to organization and to method of practice, together with further objects and advantages thereof, will best be understood by reference to the following specification, taken in connection with the accompanying drawings, in which.

DETAILED DESCRIPTION OF THE PREFERRED EMBODIMENT

Figure 1:
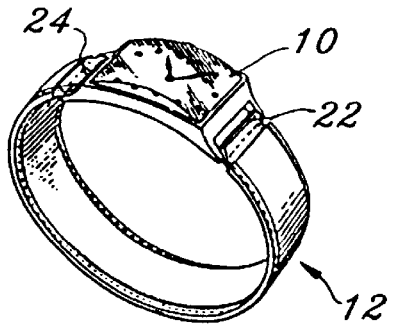
Fig. 1 (Prior Art)
FIG. 1 is a perspective view of a prior art expandable strap for a wristwatch.
Figure 2:
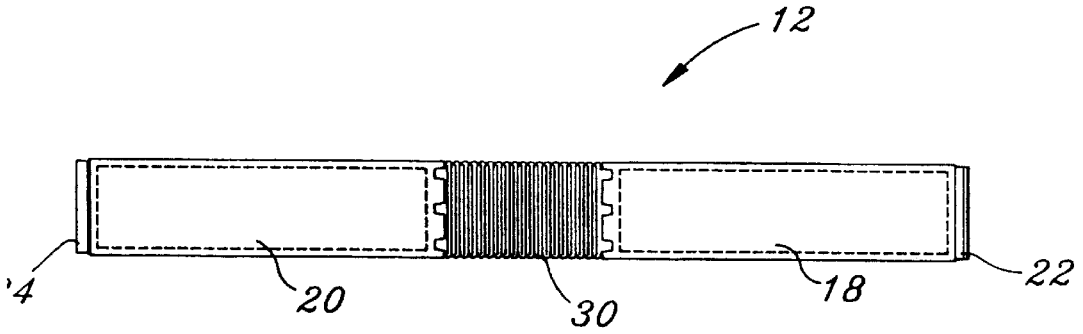
Fig. 2 (Prior Art)
FIG. 2 is an elevational view showing the inner structure of the prior art expandable strap of FIG. 1.
Figure 3:
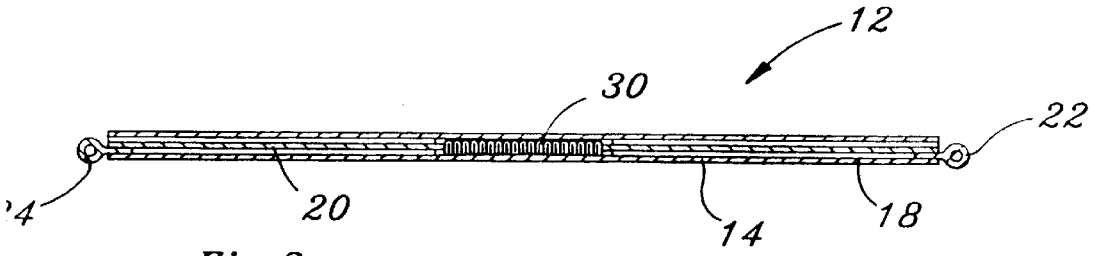
Fig. 3 (Prior Art)
FIG. 3 is a longitudinal cross-sectional view of the prior art expandable strap of FIG. 2.
Figure 4:
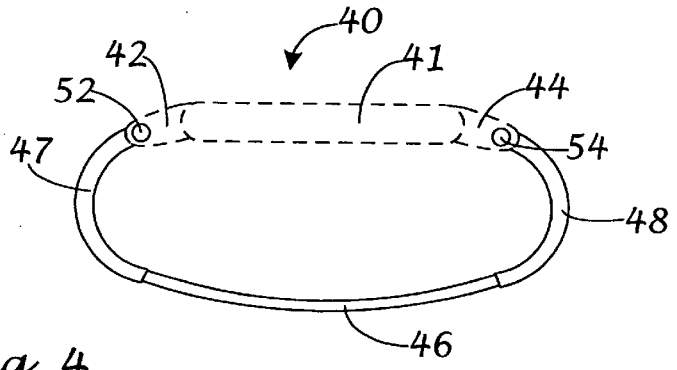
FIG. 4 is a side view of an improved wrist instrument in accordance with the present invention.

In accordance with the preferred embodiment of the present invention, FIG. 4 shows a wrist instrument, generally indicated by reference numeral 40, having a case 41 with first and second pairs of conventional spaced attachment lugs 42 and 44 thereon. The case 41 is held on a wrist by means of a strap 46, which is further illustrated in FIG. 5.

Figure 5:
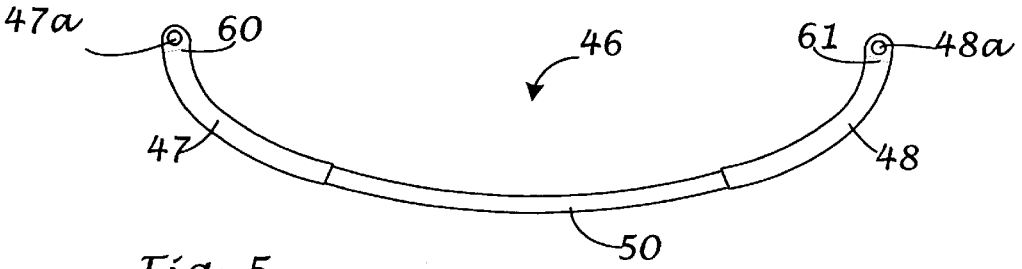
FIG. 5 is a longitudinal side view of an expandable strap in accordance with the present invention.

FIG. 5 shows the strap 46 having a first strap casing or sheath 47 and a second strap casing or sheath 48 on each end, with an interconnecting member 50 therebetween. As will be described hereinbelow, the interconnecting member 50 comprises a non-expandable section with elastic members on the ends thereof Although the strap casings 47 and 48 and the non-expandable section of the interconnecting member 50 are preferably made of leather, they may also be made of other materials, such as laminated plastic, rubber solid or metal. The first and second strap casings 47 and 48 are respectively, pivotably connected between the first and second pairs of attachment lugs 42 and 44 by means of pins or spring bars 52 and 54 extending through apertures 47*a* and 48*a* located in the strap casings 47 and 48.

Figure 6:
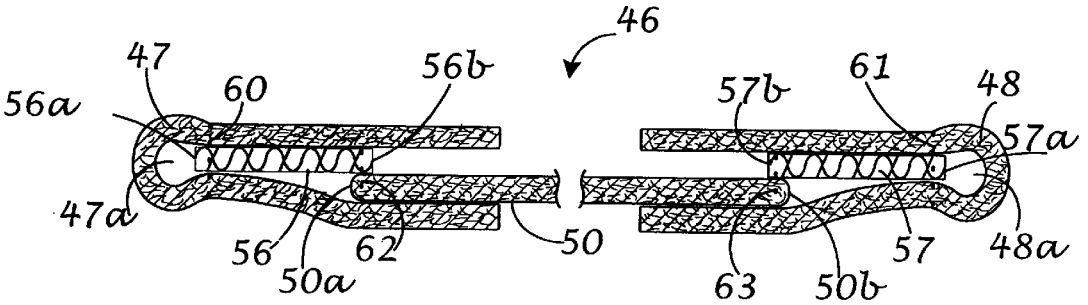
FIG. 6 is an enlarged longitudinal cross-sectional view of the expandable strap in accordance with the preferred embodiment of the present invention.

FIG. 6 is an enlarged cross-sectional view of the strap 46 of FIG. 5 showing the internal structure of the first and second strap casings 47 and 48. Inside the first strap casing 47, there is positioned a first elastic member 56 having a first end portion 56*a* and a second end portion 56*b*. The first end portion 56*a* of the first elastic member 56 is attached to the first strap casing 47, preferably by means of stitches 60, which are shown in FIG. 5 and FIG. 6. The second end portion 56*b* of the first elastic member 56 is attached to a first end portion 50*a* of the non-expandable section of the interconnecting member 50, also preferably by means of stitches 62 (FIG. 6). Inside the second strap casing 48, there is positioned a second elastic member 57 having a first end portion 57*a* and a second end portion 57*b*. The first end portion 57*a* of the second elastic member 57 is attached to the second strap casing 48, preferably by means of stitches 61, which are shown in FIG. 5 and FIG. 6. The second end portion 57*b* of the second elastic member 57 is attached to a second end portion 50*b* of the non-expandable section of the interconnecting member 50, also preferably by means of stitches 63 (FIG. 6). The first and second elastic members 56 and 57 are preferably of a conventional type used to constrict portions of an article of clothing upon a wearer, but may alternatively be of elastomeric material such as rubber, or may be elastic spring members.

The operation of the strap 46 for the wrist instrument 40 of the present invention is as follows. When a user desires to place the instrument 40 around his or her wrist, the user will pull on the interconnecting member 50 to stretch the strap 46 so as to permit the instrument 40 to slide past the user's hand. The stretching of the strap 46 is possible because the pulling action on the non-expandable section of the interconnecting member 50 causes the first and the second elastic members 56 and 57 to expand within the first and the second strap casings 47 and 48, respectively. To ensure that the elastic members 56 and 57 do not expand beyond the confines of the strap casings 47 and 48, the following factors must be taken into account: the length of the strap casings 47 and 48, the length of the elastic members 56 and 57, the maximum stretch length of the elastic members 56 and 57, the length of the non-expandable section of the interconnecting member 50, and the maximum expected pull on the interconnecting member 50. Based upon an accounting of these factors, the strap 46 can be designed to fully conceal the elastic members 56 and 57 within the strap casings 47 and 48 at all times. Once the instrument 40 has been placed around the user's wrist, the first and the second elastic members 56 and 57 will stretch, as necessary, to provide a secure and a comfortable fit. Furthermore, since the elastic members 56 and 57 are always fully concealed and the strap 46 always maintains the same appearance (unlike the aforementioned '007 patent where the strap sections 18 and 20 are suddenly exposed to view underneath the casing 14 when the strap 12 is expanded), the wrist instrument 40 of the present invention is provided with a natural, attractive appearance at all times.

The strap 46 may be modified to provide an elastic member within only one of the strap casings. This alternative design will still achieve the benefits of the invention without departing from the scope of the invention.

While there has been described what is considered the preferred embodiment of the invention and a modification thereof, other modifications of the present invention will occur to those skilled in the art, and it is desired to secure in the appended claims all such modifications as fall within the true spirit and scope of the invention.

I claim:

1. An improved wrist instrument of the type having a case, wherein the improvement comprises a strap comprising a first strap casing and a second strap casing, each strap casing being attached to the case, and an interconnecting strap member connected to the first strap casing and the second strap casing, the interconnecting strap member including a non-expandable strap section having an appearance similar to that of the first and second strap casing and at least one elastic strap member which is completely housed in one of the strap casings, the elastic strap member being attached to both the strap casing housing it and the non-expandable strap section of the interconnecting strap member such that when a pulling force is exerted on the interconnecting member, the elastic strap member expands within the strap casing to allow the strap to accommodate different wrist sizes without exposing the elastic strap member to view.

2. The improved wrist instrument according to claim 1, wherein the first and the second strap casings are made of leather.

3. The improved wrist instrument according to claim 1, wherein the non-expandable strap section of the interconnecting strap member is made of leather.

4. The improved wrist instrument according to claim 1, wherein the elastic strap member is attached to the strap casing housing it by stitches.

5. The improved wrist instrument according to claim 1, wherein the elastic strap member is attached to the non-expandable strap section of the interconnecting member by stitches.

6. A wrist instrument comprising:

a case; and a strap comprising a first strap casing and a second strap casing, each strap casing being attached to the case by attachment means, and an interconnecting member connected to the first strap casing and the second strap casing, the interconnecting member including a first elastic member and a second elastic member and a non-expandable section attached therebetween by stitches, the first elastic member being secured to the first strap casing by stitches and housed in the first strap casing and the second elastic member being secured to the second strap casing by stitches and housed in the second strap casing such that when a pulling force is exerted on the interconnecting member, the elastic member for each strap casing expands within the strap casing to allow the strap to accommodate different wrist sizes without exposing the elastic member to view.

7. The wrist instrument according to claim 6, wherein the attachment means comprises the first and the second strap casings being positioned between first and second pairs of attachment lugs, respectively, where the first and the second pairs of attachment lugs are secured to the case, each strap casing having an aperture for receiving a pin extending from the respective pair of attachment lugs.

8. The wrist instrument according to claim 6, wherein the first and the second strap casings are made of leather.

9. The wrist instrument according to claim 6, wherein the non-expandable section of the interconnecting member is made of leather.

10. An expandable strap for a wrist instrument comprising:

a first strap casing and a second strap casing, the first and the second strap casings each having an aperture for use in connecting the strap to a case of the wrist instrument; and an interconnecting member comprising a first elastic member and a second elastic member and a non-expandable section attached therebetween, the first elastic member being housed within the first strap casing and having a first end portion secured to the first strap casing by stitches and a second end portion attached to a first end portion of the non-expandable section by stitches, the second elastic member being housed within the second strap casing and having a first end portion secured to the second strap casing by stitches and a second end portion attached to a second end portion of the non-expandable section by stitches such that when a pulling force is exerted on the interconnecting member, the first and the second elastic members expand within the first and the second strap casings, respectively, to allow the strap to accommodate different wrist sizes without exposing the elastic members to view.

11. The expandable strap according to claim 10, wherein the first and the second strap casings are made of leather.

12. The expandable strap according to claim 10, wherein the non-expandable section of the interconnecting member is made of leather.

* * * * *